United States Patent [19]

Branham

[11] 4,054,062

[45] Oct. 18, 1977

[54] HAND-HELD MICROPIPETTOR WITH IMPROVED ACCURACY OF LIQUID VOLUMES TRANSFERRED

[75] Inventor: Doud Roger Branham, Redwood City, Calif.

[73] Assignee: Oxford Laboratories Inc., Foster City, Calif.

[21] Appl. No.: 682,401

[22] Filed: May 3, 1976

[51] Int. Cl.[2] ..... B01L 3/02
[52] U.S. Cl. ..... 73/425.6; 222/146 C
[58] Field of Search ..... 73/425.4, 425.6; 222/146 R, 146 C

[56] References Cited

U.S. PATENT DOCUMENTS

| | | | |
|---|---|---|---|
| 3,834,590 | 9/1974 | Robinson | 73/425.6 |
| 3,855,868 | 12/1974 | Sudvaniemi | 73/425.6 |
| 3,935,734 | 2/1976 | Keegan | 73/425.6 |

*Primary Examiner*—S. Clement Swisher
*Attorney, Agent, or Firm*—Limbach, Limbach & Sutton

[57] ABSTRACT

A hand-held micropipettor having a construction to impede transfer of heat from a handle to a portion enclosing a piston chamber, and means for drawing room air along the piston to effect its cooling when the micropipettor is operated. A compressible piston seal is held in place with a retainer urged in an axial direction by a resilient element with an uniform force independent of the position of the piston.

12 Claims, 7 Drawing Figures

HAND-HELD MICROPIPETTOR WITH IMPROVED ACCURACY OF LIQUID VOLUMES TRANSFERRED

BACKGROUND OF THE INVENTION

This invention relates generally to liquid transferring devices, and more particularly to improvements in hand-held micropipettors that result in increased accuracy of the amount of liquid so transferred.

Within the last few years, hand-held micropipettors have become very popular as laboratory instruments, primarily in medical laboratories. The following United States patents describe existing instruments supplied by Oxford Laboratories Inc., the assignee of the present application: U.S. Pat. Nos. RE 27,637 — Roach (1973); 3,855,867 — Roach (1974); 3,882,729 — Roach (1975); and 3,918,308 — Reed (1975).

Such devices include a tube-like barrel body structure having a plunger assembly extending outward of one end thereof and a piston attached to the other end of the plunger and positioned within a piston chamber. The piston chamber is maintained in fluid communication with an aperture at an end of the barrel handle which is shaped for frictionally engaging a detachable tip. The piston is held in a normal rest position by one or more springs within the barrel handle. When used to transfer liquid, the pipettor plunger is depressed, the attached tip is placed in a liquid and the plunger released to draw a precise amount of liquid into the tip. An air interface exists between the piston and liquid. The pipettor is then removed to a container for discharge of the liquid. The liquid is discharged from the tip by again depressing the plunger.

As the popularity and applications of hand-held micropipettors increases, their users are demanding the highest degree of accuracy in volumes of liquid transferred thereby. Therefore, it is a principal object of the present invention to provide a hand-held micropipettor with increased accuracy and repeatability.

Users of such instruments are also demanding added convenience in maintenance and operation. Therefore, it is another object of the present invention to provide an improved hand-held micropipettor with increased convenience of use and maintenance.

SUMMARY OF THE INVENTION

Briefly, a principal aspect of the improved hand-held micropipettor according to the present invention is the provision of air cooling of its liquid transfer piston so that heat from the hand of a user of the micropipettor does not cause the air interface between the piston and the liquid to be transferred to heat up enough to cause erroneous amounts of liquid to be transferred by its use. The particular advantage of preventing heat transfer from the operator's hand to the operable air interface is that the amounts of liquid transferred by the device will not change from hand heat over a period of use. This improved repeatability of liquid transfer results in a most important characteristic of a precision device.

This air cooling improvement is especially advantageous for large volume micropipettors such as those in the neighborhood of 1 milliliter liquid transfer capability, or greater. Alternatives to this cooling technique, such as placing the piston chamber further away from the handle portion of the micropipettor by making it longer, makes the instrument more expensive to manufacture and less suited for many uses desired by laboratory operators.

According to a preferred form of this aspect of the invention, an air pump is provided within the pipettor separate and apart from its normal liquid transfer piston chamber assembly. This pump is oriented with respect to an opening through the body of the micropipettor so that when the pump operates, air is drawn past the piston, thereby reducing undesired heat flow into that chamber. The pump also expels air within the micropipettor body that is heated by the operator's hand. The pump is made to be operable simultaneously with operation of the micropipetting device in transferring liquid.

As another accuracy improving feature of the present invention, a compressible resilient piston sealing ring is held within the micropipettor adjacent one end of a piston chamber into which the piston enters. It is held in place by a spring element urging the seal against a fixed seal retainer. This spring is not compressed or stretched by any operation or use of the micropipettor but rather is provided for the sole function of loading the piston sealing ring. This means that exactly the right loading force can be provided to the sealing ring by the manufacturer for optimum operation at all times.

If this force on the seal is not optimum throughout the full movement of the piston, as is the case in existing devices, the seal itself can move and cause an uncontrolled air displacement within the piston chamber, thus undesirably affecting the amount of liquid transferred by the device. It is common practice in existing micropipettors to load a seal with a resilient force that varies because the loading spring also serves another function within the micropipettor. Another prior technique is to threadedly clamp the seal between two fixed surfaces but this has a disadvantage that the force on the seal will vary depending upon who clamps them together.

Additional objects, advantages and features of the present invention will become clear from the following detailed description which should be taken in conjunction with the accompanying drawings.

DESCRIPTION OF THE PREFERRED EMBODIMENT

Figure 1:
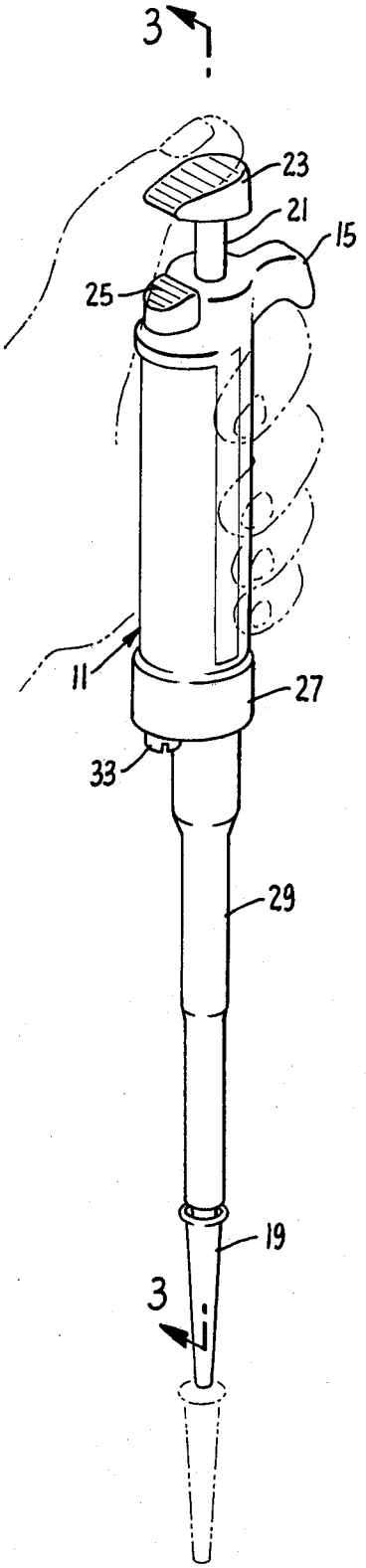
FIG. 1 shows a hand-held micropipettor embodying the various aspects of the present invention.
Figure 2:
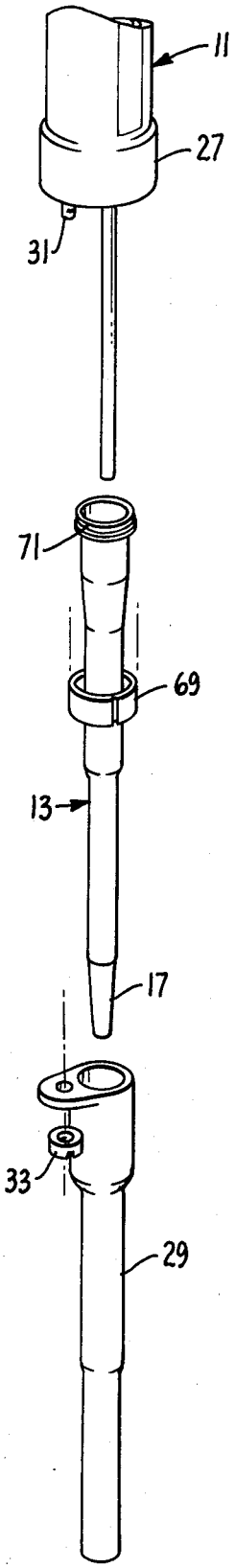
FIG. 2 is an exploded view of the major components of the micropipettor of FIG. 1.
Figure 3:
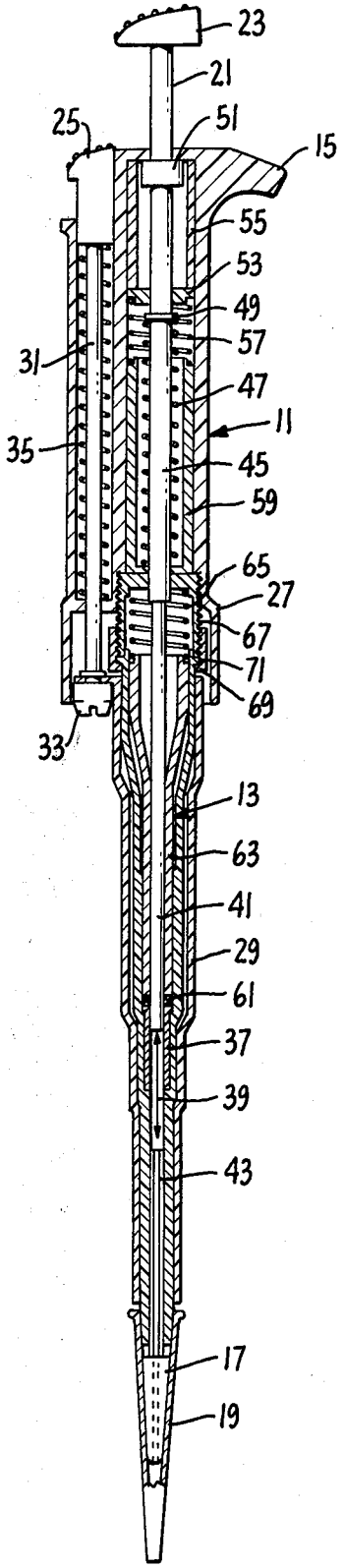
FIG. 3 is a cross-sectional view of the micropipettor of FIG. 1 taken across section 3—3 thereof.
Figure 4:
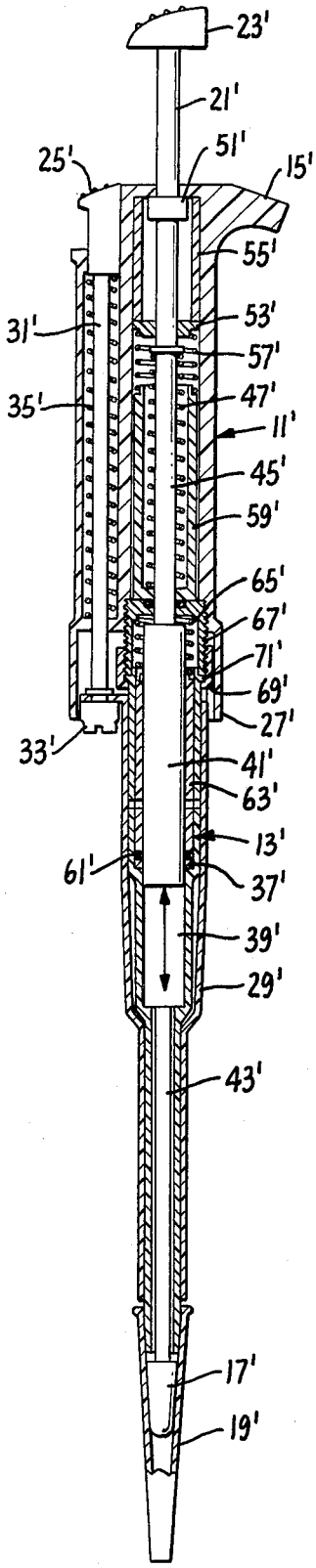
FIG. 4 is a cross-sectional view of a second embodiment of a micropipettor utilizing an improvement that is part of the present invention not shown in any of the FIGS. 1-3.

Referring initially to FIGS. 1-3, the micropipettor body includes an upper barrel handle portion 11 having a lower barrel portion 13 threadedly attached thereto at one end thereof. At an opposite free end of the barrel handle 11 a finger hold 15 protrudes radially out from the generally cylindrical member 11. A free end 17 of the lower barrel portion 13 is conically shaped for frictionally engaging the interior of a disposable plastic pipette tip 19.

Extending outward of the free end of the barrel handle is a plunger 21 that is slidable into and out of that end of the barrel handle. Attached to the free end of the plunger 21 is a liquid transfer knob 23. Immediately adjacent the free end of the barrel handle is a separate tip ejector knob 25 that is provided on a side of the plunger 21 opposite to that of the finger hold 15. At the end of the barrel handle 11 to which the lower barrel 13 is attached, a enlarged diameter flange 27 is provided. The length of the barrel handle 11 between the finger hold 15 and the flange 27 is of substantially the same cross-sectional shape and adapted in length to receive the operator's fingers in a manner illustrated in dashed outline in FIG. 1. The operator's thumb is bent in a position to selectively operate each of the liquid transfer knob 23 and tip ejector knob 25.

The tip ejecting mechanism operably connected to the knob 25 includes a tip ejector sleeve 29 that is slidable in an axial direction along the length of the lower barrel 13 which it surrounds. The tip ejecting sleeve 29 is connected to the knob 25 by a tip ejector coupling rod 31 and an appropriate threaded nut 33 engaging one end of the rod 31. The opposite end of the rod 31 is preferably molded into the knob 25. When the operator has completed a liquid transfer operation using the instrument shown in FIGS. 1–3, the operator then presses the knob 25 which causes the sleeve 29 to move a distance along the lower barrel 13 sufficient to push off the tip 19. A spring 35 captured within the barrel handle member 11 holds the tip retaining sleeve in a normal position as shown in FIG. 3 wherein it does not interfere with the tip 19.

A sleeve 37 is provided within the lower barrel 13 and forms a portion of a piston chamber 39. A piston 41 operably moves back and forth over the distance shown by the arrow in FIG. 3 as the instrument is used for its liquid transfer function. At an opposite end of the piston chamber 39 from that into which the piston 41 extends, a fluid path 43 extends from the piston chamber 39 through the barrel 13 and its tip 17. This passage provides a fluid communication between the piston chamber and the interior of the detachable tip 19. In normal use, liquid being pipetted by the device is not drawn into the passage 43 at all but rather the liquid remains in the detachable tip 19. Thus, there remains an air interface between the liquid being pipetted in the tip 19 and the piston 41.

The piston 41 is operably connected to the liquid transfer knob 23 through a plunger assembly including the plunger element 21 and a piston rod extender 45. The entire assembly of the piston 41 and the plunger assembly elements 21 and 45 move axially along the length of the micropipettor by an operator through the knob 23. The normal position of this assembly is that shown in FIG. 3 wherein a spring element 47 is fixed at one end to the extender rod 45 by some appropriate ring or pin 49. When used for pipetting liquids, the operator despresses the knob 23 against the force of the spring 47 until a primary stop 51, rigidly attached to the rod 45, strikes a plunger stop 53 provided as a closed end to a cylindrical calibration sleeve 55. The distance between the rest position shown in FIG. 3 and the position wherein the stop 51 abuts the stop 53 is the normal calibrated liquid transfer distance. The volume of liquid transferred by the device is thus controlled by the length of the calibration sleeve 55.

When the operator further despresses the knob 23 while the stop 51 is abutted against the stop 53, the calibration sleeve 55 and its stop 53 will move within the barrel handle 11 against the force of a secondary spring 57. The secondary spring 57 is made to be much stronger than the primary spring 47 so that the operator will know by differences in force required when the secondary spring 57 is being operated against. The sprint 57 is held in place between one side of the plunger stop 53 and a secondary spring retainer 59.

In a forward mode operation, only the primary spring 47 is utilized when drawing liquid into the pipette tip 19 while upon discharge of liquid from the tip 19 the operator depresses the knob 23 in a manner to compress the secondary spring 57 as well. This latter operation is sometimes referred to as an "overshoot" operation of a piston. The purpose of such an overshoot is to make sure that all liquid that might be attached to the side walls of the interior of the tip 19 is displaced therefrom.

In a reverse mode operation, both the primary spring 47 and the secondary spring 57 are initially compressed prior to drawing liquid into the tip 19. The piston assembly is then allowed to return to its rest postion. For discharge of the calibrated volume of liquid from the tip 19, the knob 23 is depressed against the primary spring 47 only. The secondary spring 57 is not compressed.

The piston 41 is sealed to the piston chamber 79 by a compressible "O" shaped seal 61 which surrounds and contacts the piston 41. The seal 61 is held in axial position by fixedly abutting up against one end of the piston chamber forming sleeve 37. A seal retainer 63 is provided with one end thereof urged against the opposite side of the seal 61 by a piston seal compressor spring 65. The retainer 63 is held loosely about the piston 41 and is slidable in an axial direction within the lower barrel portion 29 except for the influence of the spring 65. It will be noted that the spring 65 is maintained in a constant state of compression no matter what position the piston 41. This means that the force applied to the seal 61 in an axial direction is substantially uniform and may be carefully controlled by the manufacturer of the micropipettor.

The piston seal 61 is preferably a Quad-X brand seal, commercially available from the Minnesota Rubber Company. The characteristic of this seal is that instead of being round in cross section as the ordinary O-ring seal, this seal has a cross sectional shape of an "X". The advantage of this type seal is that it provides two rounded sealing edges that contact the piston 41, providing a better seal and reduced frictional drag on the piston. This type seal also permits a lower force applied by the spring 65.

The use of a separate spring 65 to load the seal 61 has a principal advantage that since the force on the seal 61 can be optimally selected and since it remains constant throughout and operational cycle of the pipettor, the seal 61 itself will not move axially. If it does, small amounts of air are displaced within the piston region 39 and results in inaccuracies in liquid transfer. With the particular type of "X" seal 61 that is preferably employed, the constant force against it prevents the two piston contacting lobes of the seal from being pushed together during part of the piston cycle as they might in other pipettor constructions that have heretofore been used.

The lower barrel portion 13 is attached to the handle barrel portion 11 by means of an adapter 67 and a coupling nut 69. The adapter is threaded on the outside with mating threads being provided on the inside of the barrel handle member 11 adjacent an edge of the outward flange 27. The coupling nut 69 engages a lip 71 annually extending around the end of the lower barrel portion 13 and clamps it up against the mating underside of the adapter 67.

An advantage of the structure of the micropipettor described with respect to FIGS. 1–3 is that heat from the hand of an operator who grasps the barrel handle 11 has little affect upon the accuracy of the liquid transferred. A problem that can occur is that heat may be transmitted from the hand to the barrel handle 11 and thence through other parts of the micropipettor to the piston 41 or the elements that form the piston chamber 39 and the passage 43. If such a heat transfer occurs, the air interface within the piston chamber 39 and the passage 43 will change in volume. As this volume changes, so does the amount of liquid drawn into the pipette tip 19. For extremely precise instruments, it is thus desired to prevent such heat transfer from occurring.

Such heat transfer is impeded by the construction of the pipettor according to FIGS. 1–3 by several techniques. First, the piston chamber 39 is moved as far as practical from the barrel handle 11. Secondly, the double threads provided by the adapter 67 and coupling nut 69 between the barrel handle 11 and the lower body portion 13 impedes heat transfer between the two. The metal spring 65 is made to be short since its metal readily conducts heat, the sleeve 63 being made of a low heat conductive plastic. In fact, all of the parts of the pipettor illustrated in FIGS. 1–3 where practical are made of low heat conducting plastic. However, for dimensional stability and strength, the piston 41, the piston rod extender 45 and each of the four springs utilized are made of metal which has a much higher capacity for conducting heat. The flange 27 is provided with space thereunder for air flow around the top portion of the lower barrel 13.

An additional feature that aids in reducing the amount of heat transferred from the barrel handle 11 to the air interface below the piston is a cooling structure which operates by drawing air into the micropipettor and discharging it simultaneously with liquid transfer operations being conducted. This additional feature is shown in the embodiment of FIGS. 4–7, wherein elements corresponding to those of the previously described embodiment shown in FIGS. 1–3 are given the same reference number with a prime (') added thereto. The embodiment of FIGS. 4–7 additionally is constructed to transfer larger volumes of liquid than that of the embodiment previously described with respect to FIGS. 1–3. As the volume of air interface between the piston and the liquid pipetted increases, so increases the potential error if this air is permitted to heat up.

Figure 5:
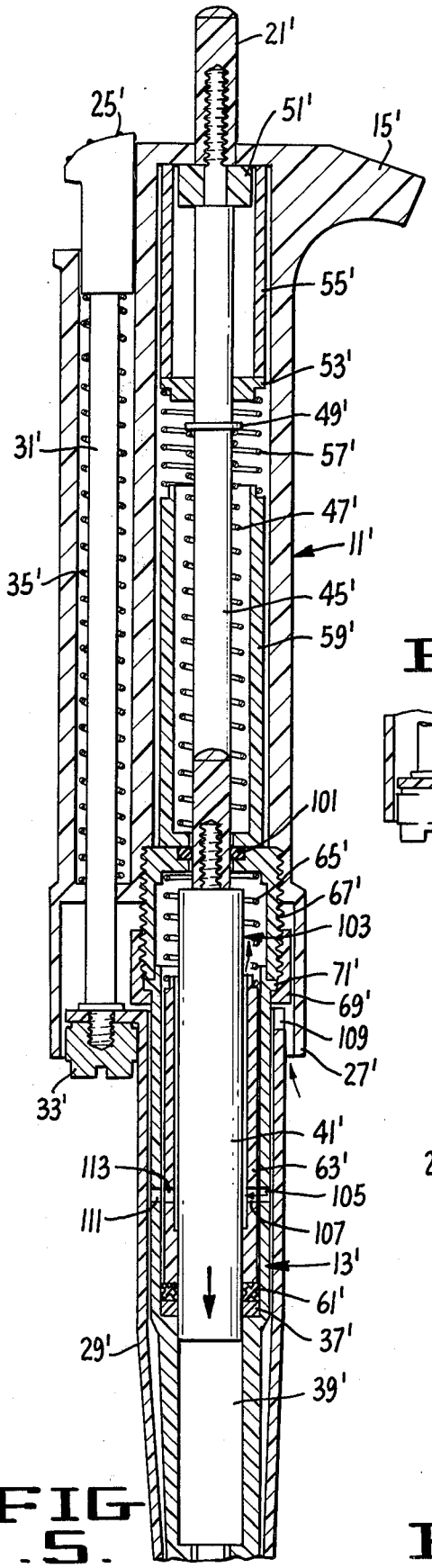
FIG. 5 is an enlarged view of a portion of the cross-sectional view of FIG. 4.
Figure 6:
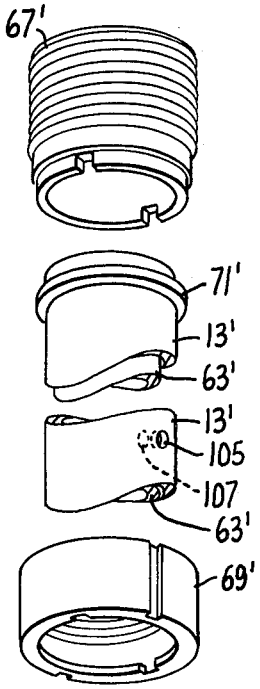
FIG. 6 shows an exploded view of a few components of the micropipettor embodiment of FIGS. 4 and 5.

Referring principally to FIG. 5 as an illustration of the embodiment of FIGS. 4–7, it will be seen that where the piston rod extender 45' is positioned axially through an opening in the adapter 67' that an O-ring 101 is provided. The O-ring is held in place against the adapter 67' in a slot provided for that purpose by the force of the primary spring 47' and the secondary spring 57' against the secondary spring retainer 59'. An air tight chamber 103 is thus formed axially between the seals 101 and 61'.

In order to provide an exchange of cooling air into and out of the chamber 103, at least one set of coaligned openings 105 and 107 are provided through the lower barrel 13' and the piston seal retainer 63', respectively. An opening 109 is also provided at the upper edge of the tip ejecting sleeve 29'. The result is that because of the significantly different diameter of the piston 41' and the piston rod extender 45' that are joined within the chamber 103, movement of the piston and its extending rod within that chamber causes air to flow in a path including the apertures 105, 107 and 109. The tip ejecting sleeve 29' is loosely fit around the lower barrel 13' so air flows freely between the apertures 105 and 109 between these two elements. Similarly, within the body 13', the piston seal retainer 63' surrounds the piston 41' but in a loose fitting manner so that air can easily flow therebetween.

Figure 7:
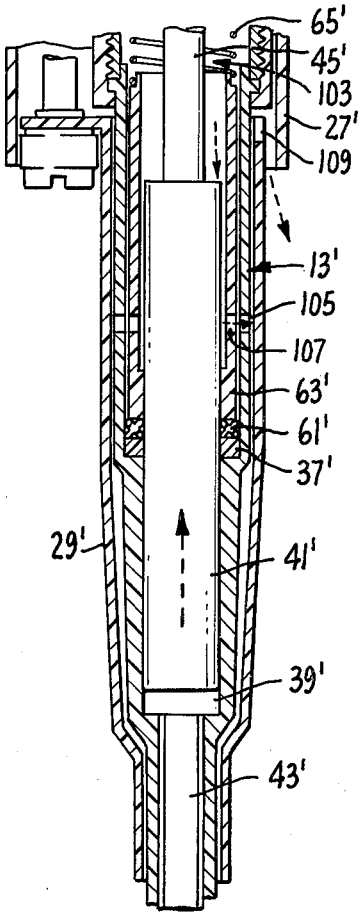
FIG. 7 shows a portion of the view of FIG. 5 with certain elements in a different operating position relative to other elements.

In operation, air is drawn into the chamber 103 through the apertures 109, 105 and 107 when the piston 41' is depressed downward as shown in FIG. 5. Conversely, air is expelled from the chamber 103 in an opposite direction, as shown in FIG. 7, when the piston 41' is permitted to travel upwards toward its rest position. The upper portion of the chamber 103 thus acts as a pump moving room air along the outside of the piston 41' into the chamber 103 and then out again. This results in cooling the metal piston 41'. Furthermore, this exchange of air will expel any heated air that might by chance get into the chamber 103 from the area within the barrel handle 11' that is directly held by the operator's warm hand.

If desired, another set of aligned openings 111 and 113 can be provided through the lower barrel 13' and the piston seal retaining sleeve 63'. The number of openings to be provided depends on the volume of air to be moved into and out of the chamber 103. The openings should be placed near the seal 61' so that as much of the piston 41' as possible is cooled by air traveling over its surface as the pumping action of the chamber 103 is permitted to draw air over the piston and then expel it again. It will also be noted that the upper portion of the chamber 103 serves to store a large volume of air during the time that the piston is depressed downwardly, only to lose that air as the piston returns to its rest position more fully within the chamber 103.

Although the various aspects of the present invention have been described with respect to preferred embodiments thereof, the invention herein is entitled to protection within the full scope of the appended claims.

I claim:

1. In a hand-held liquid transfer pipetting device, comprising:

an elongated hollow body, a piston chamber within said body, a piston entering one end of said piston chamber and reciprocally held relative thereto, and means extending from said piston out of one end of said body to a knob for providing such reciprocal motion to said piston, the improvement comprising means within said body operable as said piston and said reciprocal motion means reciprocate for drawing air from outside the pipettor into the body in a direction past portions of the piston without any of said drawn air getting into the piston chamber, whereby the portion of the piston outside the piston chamber at any instant is cooled by the drawn air.

2. In a hand-held liquid transfer pipetting device, comprising:

an elongated hollow body, a piston chamber within said body, a piston entering one end of said piston chamber and reciprocally held relative thereto, means extending from said piston out of one end of said body to a knob for providing such reciprocal motion to said piston, and a piston seal adjacent said one end of the piston chamber, the improvement comprising:

at least one opening through said body in the vicinity of said seal but outside said piston chamber, and means including an air pump within said body for moving air into and out of said opening and in a direction within said body along the length of the piston extending outside of said piston chamber, whereby said piston is cooled.

3. In a hand-held liquid transfer pipetting device, comprising:

an elongated body having a handle barrel portion that is shaped to be gripped by a human hand and a lower portion extending from one end of the handle barrel, a piston chamber provided within the lower portion of said body, a piston disposed within said body for operable reciprocal motion in said piston chamber, a piston seal provided within the lower body portion at one end of said piston chamber through which said piston enters said chamber, a plunger assembly connected at one end thereof within said body to the piston and extending out of another end of the handle barrel portion to terminate at its other end in a knob, a resilient element within said body normally urging said piston and plunger assembly in a direction toward said another end of the handle barrel assembly to a rest position, a free end of said lower body portion being shaped to engage the interior of a detachable tip, and a fluid passage within said lower body portion from the interior of said tip to another end of said piston chamber, whereby operation of said knob operates said piston to displace fluid within the piston chamber and said fluid passage, thus causing liquid to be drawn into the dispensed from said detachable tip, the improvement comprising:

a second seal positioned within said body a distance towards said another end of the barrel handle assembly from said piston seal, thereby forming an air cooling chamber along the length of said body between said seals, a connecting rod as part of said plunger assembly passing through said second seal in a fluid tight manner and attaching to said piston, at least a portion of said connecting rod that enters said cooling chamber through said second seal and a portion of said piston rod that enters said piston chamber through said piston seal having cross-sectional areas that are substantially different, and said cooling chamber being substantially fluid tight except for at least one opening through said body between said chamber and the outside thereof, whereby air is moved in and out of said cooling chamber through said wall opening upon movement of said piston rod and said connecting rod back and forth through said air cooling chamber.

4. The pipetting device according to claim 3 wherein as part of said improvement said at least one opening through the body wall from said cooling chamber is positioned along the length of said body near said piston seal, whereby air is drawn through said opening and along the length of most of the piston as it is operated back and forth.

5. The pipetting device according to claim 3 wherein as part of said improvement the length of the piston within said air cooling chamber when in the rest position is of a uniform cross-sectional area along its length, and the plunger assembly portion within said air cooling chamber when fully depressed into the said body is also of a uniform cross-sectional area along its length, said cross-sectional areas being significantly different, wherein said piston and said plunger assembly are joined within the air cooling chamber to form an abrupt change of cross-sectional areas, whereby air is moved between said cooling chamber and outside of the body through said opening when the piston and plunger assembly are moved relative to the body.

6. The pipetting device according to claim 3 wherein as part of the improvement said lower portion of the body is attached to the handle barrel portion of the body by two sets of threads, whereby heat transfer between the handle barrel and lower portion of the body is impeded.

7. The pipetting device according to claim 3 wherein as part of the improvement said piston seal is made of a compressible material, and further wherein a seal retainer sleeve is provided within said cooling chamber loosely surrounding said piston with space enough for air to flow therebetween, one end of said seal retainer contacting said seal, and a resilient element provided within said cooling chamber urging said retainer in a manner that said seal is compressed and forced against said piston, said resilient element exerting substantially the same force against said seal retainer throughout all positions of said piston during operation of the pipettor, said seal retainer having at least one opening therein aligned with said at least one opening through said body, whereby operation of the piston and plunger assembly causes air to move along the surface of a portion of said piston thereby to cool it.

8. The improved pipetting device according to claim 1 which additionally comprises a tip ejecting sleeve surrounding the lower portion of said body and movable therealong from a resiliently held rest position to an operable position that forces from said free end of the lower body portion any tip that is held thereby, a tip ejector knob provided at said another end of said barrel handle in a position adjacent said piston operating knob, and a tip ejecting coupling rod connecting said tip ejector knob to said tip ejector sleeve in a manner that operation of said knob operates said sleeve to eject a tip from said tip filler, said sleeve loosely fitting over said lower body portion and covering said openings through said lower body into the cooling chamber, whereby air flows around an end of said tip ejecting sleeve to said opening as air is transferred into and out of said cooling chamber.

9. In a hand-held liquid transfer pipetting device, comprising:

an elongated hollow body having one defined end, a piston chamber within said body and axially aligned therewith, a piston entering an end of said piston chamber closest to said one end of the body and reciprocally held relative thereto, a piston seal positioned in said body adjacent said piston chamber end to provide a fluid tight seal between the piston and the piston chamber, means extending from said piston out of one end of said body to a knob for providing such reciprocal motion to said piston, and a first resilient element normally positioning said piston and said reciprocal providing means to a rest position toward said body one end, the improvement comprising:

said piston seal being held by said body against movement with said piston into the piston chamber by a fixed ledge, means independent of said first resilient element for resiliently compressing said piston seal in an axial direction against said fixed ledge, wherein said resilient force remains constant for all operable positions of said piston, a cooling chamber provided within said body between the position of said piston seal and a second seal located nearer said body defined end, said reciprocal motion means passing through said second seal, said cooling chamber having at least one opening through a wall of said body between the cooling chamber and the outside for air transfer therebetween, and a portion of the reciprocal motion means and piston assembly within said cooling chamber having rapidly changing cross-sectional areas, whereby the volume of air within the cooling chamber is changed as the piston and reciprocal motion means are reciprocated back and forth therein, thereby cooling the piston as the device is used.

10. The liquid transfer pipetting device according to claim 9 wherein as part of the improvement said seal comprises compressible material having a cross-sectional shape in the form of an "X" and positioned with two lobes of the "X" contacting the piston, whereby the piston is sealed in two lines therearound.

11. A hand-held liquid transfer pipetting device, comprising:

an elongated body including as at least a portion thereof a handle barrel shaped to be gripped by a human hand, a piston chamber provided within said body, a piston disposed within said body for operable reciprocal motion in said piston chamber, means for sealing said piston to said chamber, a plunger assembly connected at one end thereof within said body to the piston and extending out of one end of the elongated body to terminate at its other end in a knob, a resilient element within said body normally urging said piston and plunger assembly in a direction toward said another end of the handle barrel assembly to a rest position, and a fluid passage within said lower body portion from another end of said piston chamber to an another end of the elongated body, whereby operation of said knob operates said piston to displace fluid within the piston chamber and said fluid passage, the improvement comprising:

a second seal positioned within said body a distance towards said one end of the elongated body from said piston seal, thereby forming an air cooling chamber along the length of said body between said seals, a connecting rod as part of said plunger assembly passing through said second seal in a fluid tight manner and attaching to said piston, at least a portion of said connecting rod that enters said cooling chamber through said second seal and a portion of said piston rod that enters said piston chamber through said piston seal having cross-sectional areas that are substantially different, and said cooling chamber being substantially fluid tight except for at least one opening through said body between said chamber and the outside thereof, whereby air is moved in and out of said cooling chamber through said wall opening upon movement of said piston rod and said connecting rod back and forth through said air cooling chamber.

12. In a hand-held liquid transfer pipetting device, comprising:

an elongated hollow body, a piston chamber within said body, a piston entering one end of said piston chamber and reciprocally held relative thereto, and means extending from said piston out of one end of said body to a knob for providing such reciprocal motion to said piston, the improvement comprising:

a cooling chamber positioned within said body adjacent said one piston chamber end so that said piston and said extending means pass therethrough, sealing means for providing fluid isolation between said adjacent piston chamber and cooling chamber, and means within said body operable as said piston and said reciprocal motion means reciprocate for drawing air from outside the pipettor into said cooling chamber, whereby the portion of the piston outside the piston chamber is cooled by the drawn air.

* * * * *